United States Patent [19]

Rioux et al.

[11] 4,020,412

[45] Apr. 26, 1977

[54] HIGH-EFFICIENCY TRANSFER OF MAGNETIC ENERGY

[75] Inventors: Christian Rioux, Cachan; Michel Legentil, Orsay, both of France

[73] Assignee: Agence Nationale de Valorisation de la Recherche (ANVAR), Meuilly Sur Seine, France

[22] Filed: July 19, 1973

[21] Appl. No.: 380,654

[30] Foreign Application Priority Data

July 21, 1972 France ..... 72.26338

[52] U.S. Cl. ..... 323/43.5 R; 323/44 F; 323/62

[51] Int. Cl.[2] ..... G05F 7/00

[58] Field of Search ..... 219/10.75; 307/17, 89, 307/90, 98, 306; 321/8 CD; 323/43.5 R, 44 R, 44 F, 48, 62; 336/DIG. 1

[56] References Cited

UNITED STATES PATENTS

| | | | |
|---|---|---|---|
| 1,038,301 | 9/1912 | Cuntz | 323/44 R |
| 2,928,926 | 3/1960 | Winz | 307/17 X |
| 3,035,206 | 5/1962 | Fishman et al. | 219/10.75 X |
| 3,179,875 | 4/1965 | Keats | 323/43.5 R |
| 3,184,674 | 5/1965 | Garwin | 336/DIG. 1 |
| 3,239,749 | 3/1966 | Oriez | 323/43.5 R |
| 3,255,403 | 6/1966 | Beaver et al. | 323/43.5 R |
| 3,652,824 | 3/1972 | Okada | 323/48 X |

FOREIGN PATENTS OR APPLICATIONS

| | | | |
|---|---|---|---|
| 242,102 | 3/1960 | Australia | 307/306 |

*Primary Examiner*—A. D. Pellinen
*Attorney, Agent, or Firm*—Cameron, Kerkam, Sutton, Stowell & Stowell

[57] ABSTRACT

The magnetic energy contained in a storage inductance coil is transferred with a high degree of efficiency into a load impedance which forms part of the same circuit. The transfer is performed gradually in a series of transformations of at least one of the circuit elements so that the successive states of the circuit deviate only to a slight extent from positions of balance corresponding to a constant total magnetic energy.

20 Claims, 18 Drawing Figures

HIGH-EFFICIENCY TRANSFER OF MAGNETIC ENERGY

This invention relates to a method and to a device for the high-efficiency transfer of magnetic energy contained in an inductance coil into a load impedance. Areas of application of the method are in electrical technique and especially in the utilization of devices comprising storage coils (in order to produce magnetic fields, for example) for storing a large amount of energy which it is desired to recover with the maximum degree of efficiency.

If an inductance coil having a value of inductance L carries a current $i$, the magnetic energy stored in said coil is $W = \frac{1}{2} Li^2$ and the magnetic flux is $\phi = Li$. It will be postulated that said inducatance coil is abruptly coupled by means of a switch to another inducatance coil which can be assumed to have the same value of inductance as the first. Since the flux is conservative, a flux Li/2 and stored magnetic energy equal to $\frac{1}{8} Li^2$ is found in each inducatance coil after closure of the switch. Under these conditions, the transfer of magnetic energy from the first inducatance coil to the second has taken place with an efficiency of 25 %. While this method of transfer is generally applied in laboratory equipment since it is very simple to use, it would undoubtedly be unsuitable for circuits in which the magnetic energy has very high values since its low efficiency would result in an excessive loss of energy.

In contrast to the method of the prior art, the invention is directed to a method which consists in carrying out successive transfers of small amplitudes in order to ensure that the efficiency in the case of each transfer is as close to unity as possible, the overall transfer efficiency being in turn very close to 1.

More precisely, the invention is directed to a method for the high-efficiency transfer of magnetic energy contained in a so-called storage inductance coil into a so-called load impedance, the storage inducatance coil and the load impedance being such as to form part of the same circuit. The method is characterized in that said transfer is performed gradually in a series of transformations of at least one of the circuit elements so that the successive states of the circuit deviate only slightly from so-called positions of balance corresponding to a constant total magnetic energy.

In a preferantial alternative embodiment of the invention, both the load impedance and the storage impedance are inductance coils.

In this alternative embodiment, the invention consists of two different arrangements, depending on whether the two inductance coils between which the transfer is effected are connected by means of a switching system or whether said coils are coupled by means of a transformer having a variable transformation ratio.

The invention is also directed to a device which serves to carry the method into practical effect and is characterized in that it comprises in a preferential embodiment, a storage inductance coil having a fixed value of inductance L and a load inductance coil constituted by n partial-inductance coils $L_p$ which are connected in series and in total coupling by mutual induction, the value of $L_p$ being in the vicinity of:

$$L_p = L\left[tg\frac{\pi p}{2n} - tg\frac{\pi(p-1)}{2n}\right]^2$$

where $p$ is an integer L is a constant and $1 \leq p \leq n-1$, and that said device comprises switching means whereby the inductance coils $L_p$ within the range of $p = 1$ to $p = n-1$ inclusive are progressively put in circuit. In accordance with the second embodiment, the device comprises a storage inductance coil having a fixed value $L_1$ and a load inductance coil having a fixed value $L_2$, said coils being coupled through a transformer having a transformation ratio which, depending on the state of a plurality of switches, can assume any one of the following values:

$$K_p = \left[\frac{L_1}{L_2}\right]^{1/2} tg\frac{\pi p}{2n}$$

where the integer $p$ varies from 1 to $(n-1)$ inclusive.

The characteristic features and advantages of the invention will become more readily apparent from the following description of practical examples which are given by way of non-limitative explanation in the particular case of the preferential alternative embodiment in which the load impedance is an inductance coil although it will naturally be understood that this does not constitute any limitation of the invention which extends on the contrary to the most general case in which the load impedance is of any type. Reference is made in the following description to the accompanying drawings, in which:

A clearer understanding of the invention will be gained by first establishing the principles of a very simple graphical representation which provides a means of clearly showing the general behaviour of an electrical system comprising two inductance coils and the transfer of magnetic energy from one coil to the other.

Figure 1:
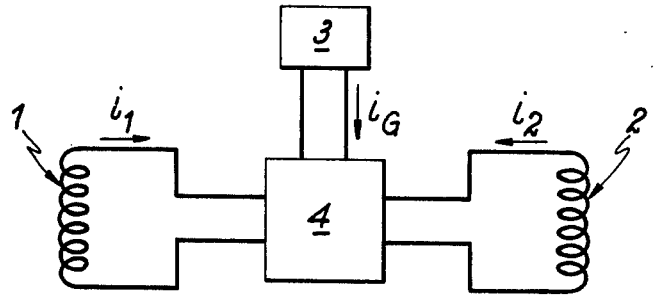
FIG. 1 is a diagram of an electric circuit which serves to define the notations employed in the description of the invention.

Consideration will first be given to FIG. 1 which represents a very general electrical system for defining the notations employed. In this figure, two ideal inductance coils 1 and 2 having the values of inductances $L_1$ and $L_2$ respectively have zero internal resistances and carry currents $i_1$ and $i_2$ respectively; a generating circuit 3 carries a current $i_G$; a junction device 4 which is neutral from the energy point of view (inductance, capacitance and resistance of zero value) ensures between the three currents $i_g$, $i_1$, $i_2$ a linear relation of the form:

$$i_G = \alpha i_1 + \beta i_2 \tag{1}$$

This structure seves as a basis for the study of energy exchanges between the three elements $L_1$, $L_2$ and the generating circuit 3. It can first be assumed that the coefficients $\alpha$ and $\beta$ are constant. The magnetic energies stored in each of the inductance coils are respectively:

$$W_1 = \tfrac{1}{2} L_1 i^2_1 \tag{2}$$

$$W_2 = \tfrac{1}{2} L_2 i_2^2 \tag{2'}$$

The total energy $W_T$ which is stored in the complete circuit and which is the sum of the energies $W_1$ and $W_2$ can be expressed simply as a function of the coefficients $\alpha$ and $\beta$, of the current $i_G$ and the values of the inductances $L_1$ and $L_2$. Conventional calculations make it possible to establish the relation:

$$W_T = \frac{1}{2[\alpha^2 L_2 + \beta^2 L_1]} [L_1 L_2 i_G^2 + \alpha^2 \beta^2 \theta^2] \quad \text{with } \theta = \frac{L_1}{\alpha} i_1 - \frac{L_2}{\beta} i_2 \tag{3}$$

Expression (3) shows that the total energy $W_T$ has a minimum value $(W_T)o$ when $i_G = 0$. When the circuit of FIG. 1 is in this condition, it is said to be balanced.

It is convenient to express energies $W_1$ and $W_2$ stored in the inductance coils 1 and 2 by means of the relations:

$$W_1 = W_T \cos^2 \theta$$

and $$W_2 = W_T \sin^2 \theta \tag{4}$$

In the state of balance defined by the angle $\theta_o$, we have:

$$tg\, \theta_o = -\frac{\alpha}{\beta} \sqrt{\frac{L_2}{L_1}} \tag{5}$$

and it can be established in a general manner that, in the case of any position which is characterized by an angle $\theta$, we have the relation:

$$\cos(\theta - \theta_o) = \frac{\Phi}{\sqrt{2W_T}} \cdot \frac{\alpha\beta}{\sqrt{L_1 \beta^2 + L_2 \alpha^2}} \tag{6}$$

Figure 2:
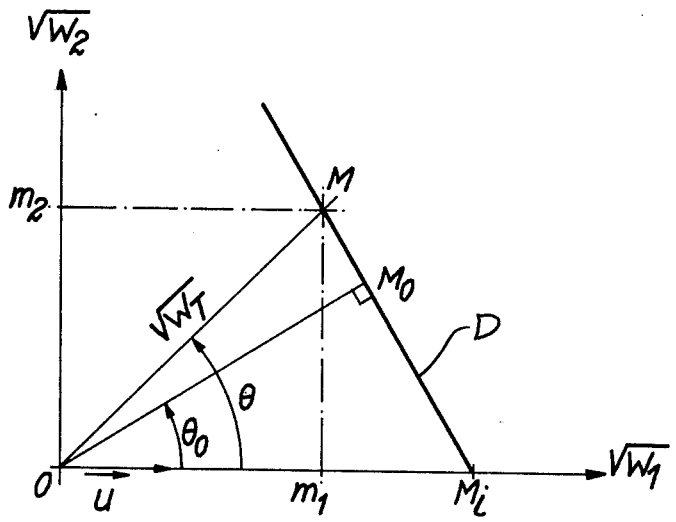
FIG. 2 is a graphical representation of the progressive variation of an electrical system of this type.

These results can be conveniently represented on a diagram having two rectangular axes on which are plotted the values $\sqrt{W_1}$ and $\sqrt{W_2}$ as shown in FIG. 2.

In this diagram, the representative point of the balance is $M_o$ such that:

$$\begin{cases} OM_o = \sqrt{(W_T)_o} \\ OM_o, u = \theta_o \end{cases} \tag{7}$$

A current point M which is representative of a particular condition of the circuit is located on a straight line D which is perpendicular to $OM_o$ at $M_o$, with the result that we have:

$$Om_1 = \sqrt{W_1}$$

and $$Om_2 = \sqrt{W_2} \tag{8}$$

This graphical representation of FIG. 2 therefore expresses the general performance of a circuit very clearly when a number of its elements are modified, with the result that relation (1) is always satisfied. From this it follows that, in the case of a circuit as shown in FIG. 1 in whih the initial state corresponds to a magnetic energy stored solely in the inductance coil 1, namely the state represented by the point $M_i$, the portion of straight line comprised between $M_i$ and $M_o$ represents the progressive variation of this system towards the final state of balance which is represented by $M_o$.

In the particular case which was considered earlier in connection with the prior art and in which the two inductance coils 1 and 2 have the same value, it is by reason of symmetry that the point $M_o$ is located on the first bisector of the system of axes and the final state is such that $\sqrt{W_1} = \sqrt{W_2}$. The transfer corresponding to the rransition from $M_i$ to $M_o$ takes place in this case with an efficiency of 25 %, whih is the value found by conventional computations. This graphical representation is employed in FIG. 3 for the purpose of explaining the principle of progressive variation of a circuit when carrying out the transfer of energy in accordance with the invention. There is shown in this figure, not a single abrupt transfer of the type which is comtemplated in FIG. 2 and which characterizes the methods of the prior art but, on the contrary, a series of $n$ transformations which permit of gradual transfer of the energy initially contained in one of the inductance coils to the other inductance coil.

Figure 3:
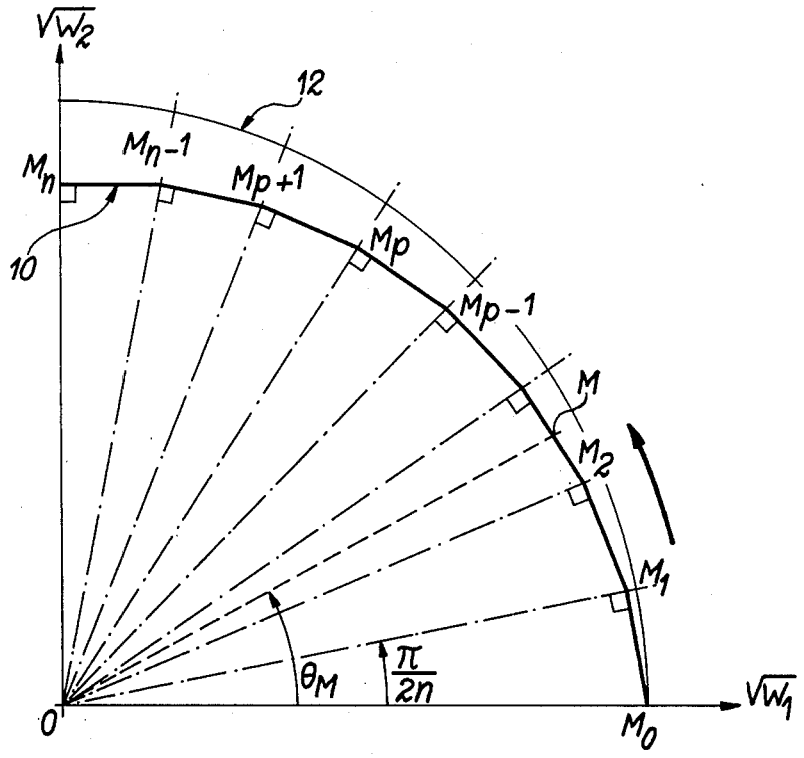
FIG. 3 is a graphical representation of the principle of progressive variation of a circuit in accordance with the invention.

In FIG. 3, the intial state of the system is represented by the point $M_o$ corresponding to a magnetic energy which is stored exlusively in the impedance having a value $L_1$, the abscissa of the point $M_o$ being $\sqrt{W_1}$. The notation $M_o$ indicates that, prior to any transformation of the circuit, this latter is in a position of balance. The first transformation of the circuit causes thr representative point of the state of the system to change-over from the point $M_o$ to the point $M_1$ such that the angle $(OM_1, OM_o)$ is equal to $\pi/2n$: This state is taken as a new initial state in a new transformation from $M_1$ to $M_2$ of the same type and amplitude as the preceding, with the result that there is a gradual progression towards the point $M_n$ having the ordinate $\sqrt{W_2}$, at which the entire magnetic energy is stored within the inductance coil having the value $L_2$. The progressive variation of the system therefore takes place along the broken line 10 whereas the ideal progressive variation having an efficiency of unity would take place along the quarter-circle 12. A current point is designated by M. It is then easy to calculate the losses sustained by the system during variation of this latter along the broken line 10 and consequently the transformation efficiency which, by definition, is equal to the ratio between the energy finally stored in the coil having the inductance $L_2$ and the energy initially stored in the coil having the inductance $L_1$. There is found:

$$\eta = \frac{(W_2)_n}{(W_1)_o} = \left(\cos\frac{\pi}{2n}\right)^{2n} \qquad (9)$$

This efficiency is closer to 1 as $n$ is of higher value or in other words as the number of transformations effected in order to change-over from the initial state to the final state becomes larger.

Figure 4:
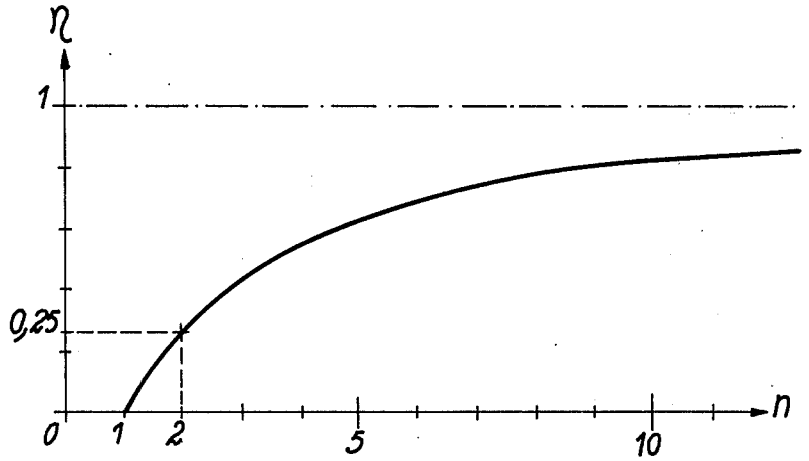
FIG. 4 is a curve of efficiency of transfer in accordance with the invention as a function of the number of transformations effected.

FIG. 4 illustrates the variations in the efficiency $\eta$ as a function of the number $n$ of transformations. In this figure, $n$ is plotted as abscissae and the efficiency is plotted as ordinates. It is apparent that, in order to attain appreciable efficiencies, it is advisable to have recourse in practice to a number of transformations which is higher than 10 and that, in the prior art in which the angle between the initial and final states is $\pi/4$ — which corresponds to $n=2$ the efficiency is 0.25.

Figure 5:
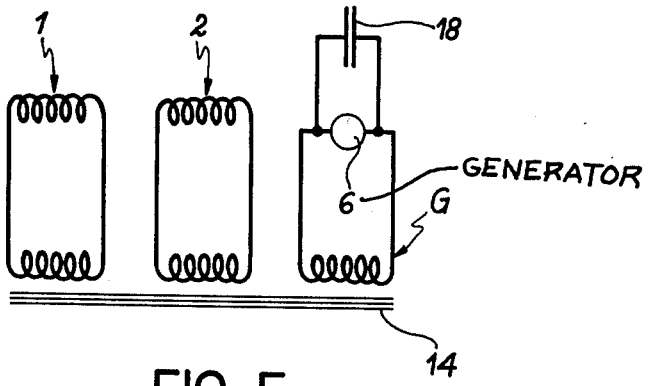
FIG. 5 is a circuit diagram in which the two inductance coils are coupled by means of a transformer to an auxiliarly resonant circuit.

In order to conclude the foregoing general remarks on the method according to the invention, reference can be made to FIG. 5 which shows an alternative mode of energy transfer. There can again be seen in this figure a particular circuit arrangement in accordance with FIG. 1 and comprising identical elements which are designated by the same reference numerals, in particular the inductance coils 1 and 2 having the respective values $L_1$ and $L_2$, said coils being coupled to each other through a transformer 14 and being intended to form the main circuit; an auxiliarycircuit G is formed by the generator 6 and by a feedback element 18 such as a capacitor, for example. The auxiliary circuit G is coupled to the main circuit by total mutual induction through the intermediary of the transformer 14. In the case of this circuit, the currents $i_G$, $i_1$, $i_2$ are again governed by a linear relation which is similar to relation (1) and therefore results in a law of variation of the total energy of the same form as the law (3). In the case of a circuit of this type, the graphical representation of FIG. 2 is again valid, the only difference being that the auxiliary circuit G comprises in this case a capacitor 18 which is capable of causing the current $i_G$ to oscillate about the position of balance. In fact, when a system which starts from the initial state characterized in FIG. 2 by the point $M_i$ reaches the state characterized by the point $M_o$, the capacitor 18 has acquired a non-zero charge. Above $M_o$, the current $i_G$ therefore changes sign and the capacitor becomes a generator. The energy of said capacitor is imparted to the main circuit which deviates from the condition of balance up to a point which is symmetrical with $M_i$ with respect to $M_o$. After having reached this point, the state of the circuit returns to the state represented by $M_o$ and there is thus obtained a movement of oscillation between $M_i$ and the point which is symmetrical with respect to $M_o$.

Figure 6:
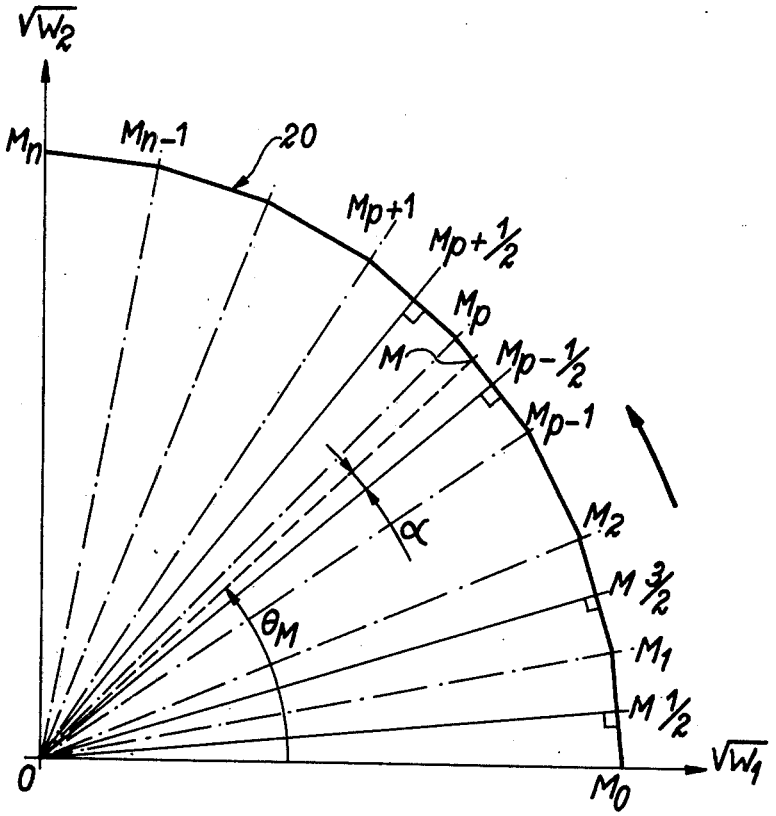
FIG. 6 is a graphical representation of the progressive variation of a system when the auxiliary circuit is in resonance in accordance with FIG. 5 and when the transformations of the main circuit are synchronized with the current oscillations in the auxiliary circuit.

If FIG. 3 which represents the progressive variation of a system having an auxiliary circuit which was not oscillating is transposed to the present case, the result obtained is shown in FIG. 6 in which the system changes over from an initial state represented by a point $M_{p-1}$ to a state represented by a point $M_p$ which is symmetrical with $M_{p-1}$ with respect to the state of balance $M_{p-1/2}$. A system whose initial state is represented by $M_o$ and provided with a feedback system such that the capacitor 18 therefore progresses towards the final state characterized by the point $M_n$ by following the borken line 20 which is inscribed within a quarter-circle having a center O, with the result that the final energy $W_2$ is equal to the initial energy $W_1$. In this case, the transfer has taken place with an efficiency of unity. This particular mode of transfer naturally entails the need to ensure that the modifications of the main circuit are synchronized with the successive charges and discharges of the capacitor 18. The instants of modification of the main circuit correspond to the vertices of the polygonal curve 20, that is to say to the points $M_{p-1}$, $M_p$, $M_{p+1}$, etc.

It can be noted that, in this alternative mode of transfer, the energy developed by the capacitor is very low in comparison with the total energy. In fact, if $n$ designates the number of sequences, the polar angle between the point $M_{p+1/2}$ representing a minimum-energy state and one of the points $M_p$ or $M_{p+1}$ corresponding to the transformations of the circuit elements is equal to $\pi/4n$, with the result that the energy developed within the capacitor is $W_T\ (\pi/4n)^2$. When $n = 8$, this energy is only one-hundredth of the total energy $W_T$. When $n = 10$, the efficiency in accordance with the first embodiment of FIG. 3 is equal to 75 % in accordance with the curve of FIG. 4 whereas the theoretical efficiency in this second embodiment of the invention is equal in principle to 100 %.

The foregoing description has been directed to the method according to the invention for the gradual high-efficiency transfer of magnetic energy in accordance with these two main alternative forms corresponding to the type of auxiliary circuits; the device which is adopted for carrying out said method will now be described.

The device aforesaid comprises two main alternative forms of construction. In the first instance, the inductance coils between which the energy is transferred are connected through a switching system and, in the second instance, the inductance coils are fixed and coupled through a transformer having a variable transformation ratio.

Figure 7:
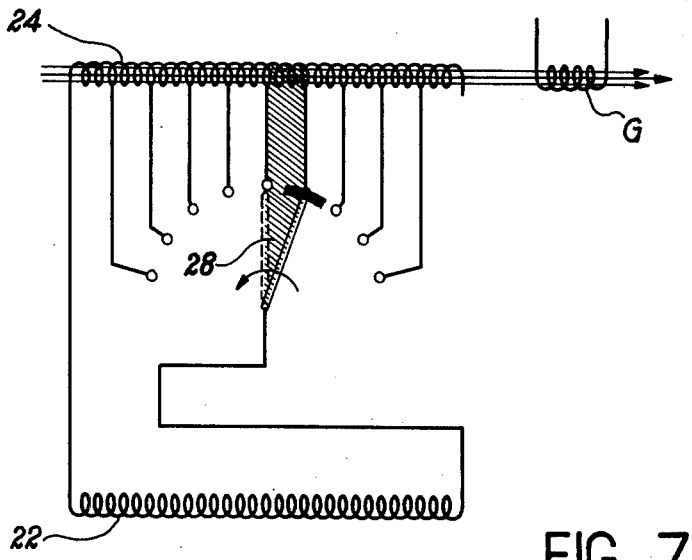
FIG. 7 is a general arrangement diagram showing the transfer of energy from a variable-inductance coil to a fixed-inductance coil.

The following description will accordingly deal with the first form of construction. FIG. 7 is a schematic diagram of energy transfer in accordance with a particular arrangement between a fixed inductance coil 22 having a value $L_2$ and a variable inductance coil 24 having a value $L_1$. In this circuit arrangement, the inductance coil 24 is coupled by total mutual induction with the auxiliary circuit G which carries the current $i_G$. As has been explained earlier, the circuit G in this variant may or may not comprise a feedback element of the capacitor type in accordance with two alternative forms of construction which correspond to the two embodiments of the method according to the invention. The transformations of at least one circuit element in accordance with the method described earlier are carried out by the means 28 representing diagrammatically a contact-stud rheostat which progressively short-circuits the inductance coil 24 from right to left, the arrow being intended to show the direction of progressive variation. The shaded area represents that portion of the inductance coil 24 which is short-circuited. The variation in magnetic flux compensates for the flux variation in the circuit G so that when the current $i_G$ falls to zero, the current within the short-circuited turns is also of zero value and a change-over to the following contact-stud can then take place. In the case of the device shown in FIG. 7, the final state is therefore characterized by a single inductance coil 22 in which the magnetic energy is localized.

Figure 8:
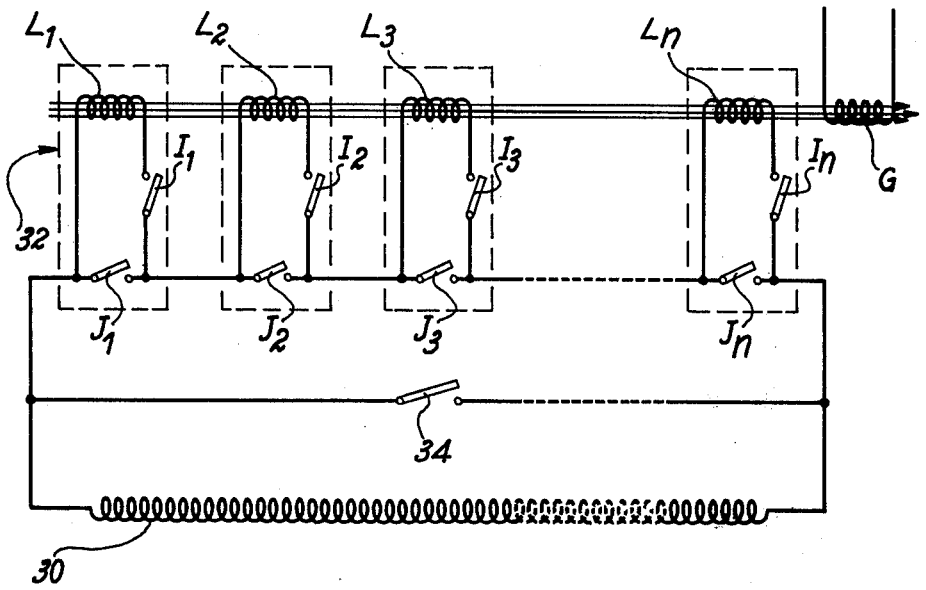
FIG. 8 is a circuit diagram in accordance with a first alternative embodiment in which the changeover means are switches.
Figure 9:
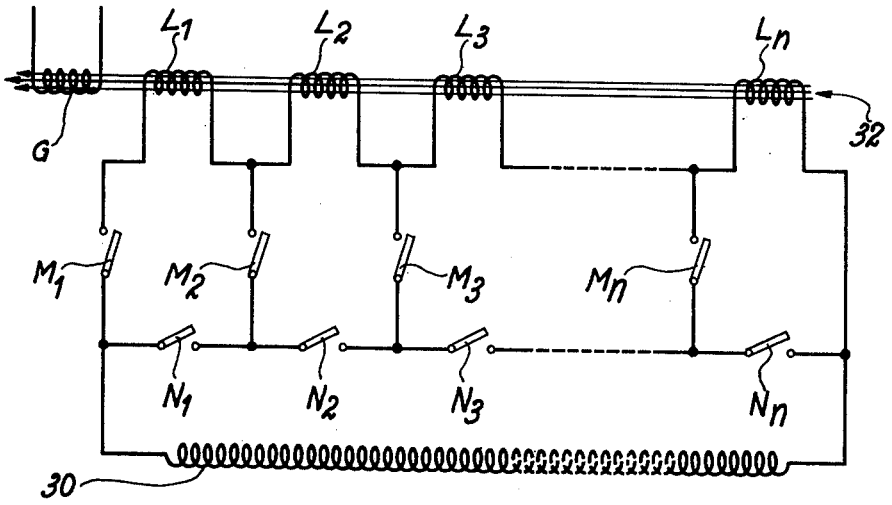
FIG. 9 is a circuit diagram in accordance with a second alternative embodiment which differs from the first embodiment in the positions of the switches.
Figure 10:
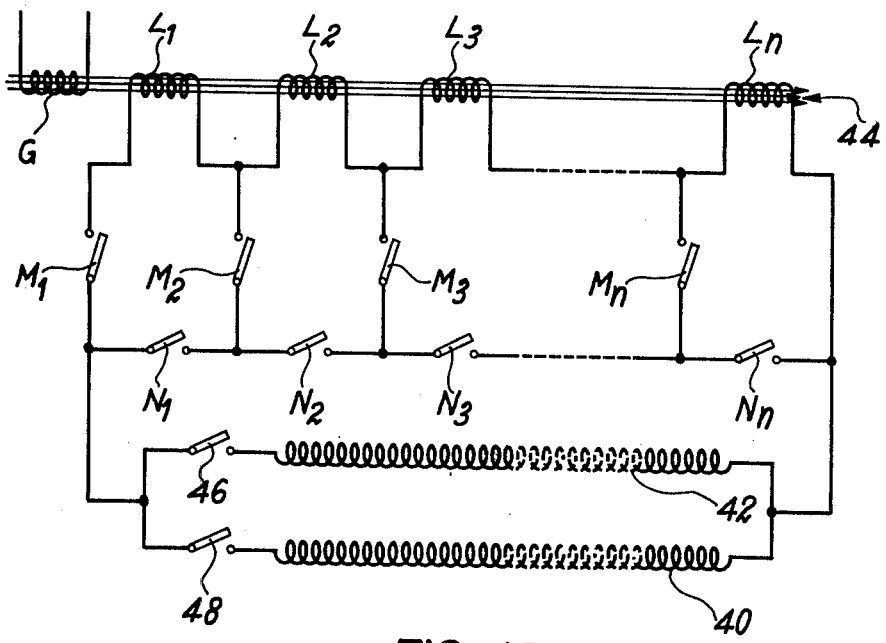
FIG. 10 is a diagram of an alternative embodiment which makes use of an intermediate inductance coil.

In FIG. 7, the switching element is a contact-stud rheostat but in order to effect the transformations of the circuit, it is also possible to employ a plurality of switches as shown in FIGS. 8, 9 and 10.

In FIG. 8, the inductance coil 30 consists of a single winding whilst the inductance coil 32 is formed on the contrary by the juxtaposed assembly of $n$ partial coils having a value of inductance $L_p$ and connected in series and in total coupling by mutual induction, where $p$ varies from 1 to $n$ inclusive. Each partial inductance coil is associated with two switches $I_1$ and $J_1$, $I_2$ and $J_2$ etc. . . $I_n$ and $J_n$; the reference 34 designates a switch in parallel with the inductance coil 30.

The operation of the device shown in FIG. 8 is as follows. It will first be assumed that the magnetic energy transfer takes place from the inductance coil 32 to the single inductance coil 30. At the initial instant, all the switches $I_1, I_2 \ldots I_n$ are closed as well as the switch 34. The switches $J_1, J_2 \ldots J_n$ are all open. The current which flows within the inductance coil 30 is zero whereas the current which flows in series within all the partial inductances coils $L_p$ is evidently not zero. In order to transfer the magnetic energy from the coil 32 to the coil 30, the following successive operations are performed:

opening of the switch 34
closure of the switch $J_n$
opening of the switch $I_n$
closure of the switch $J_{n-1}$
opening of the switch $I_{n-1}$
. . . . . .
closure of the switch $J_1$
opening of the switch $I_1$ In the final state, all switches $J_n$ are closed whilst all the switches $I_n$ are open: the energy transfer has taken place from the inductance coil 32 towards the inductance coil 30.

The transfer can clearly take place only from the coil 30 to the coil 32 in a symmetrical manner. Consideration will accordingly be given to a new initial state in which the switch 34 is open, in which the switches $J_n$ are closed and the switches $I_n$ are open. The current which flows within the inductance coils $L_p$ is zero whereas the current which flows within the inductance coil 30 is not zero. This new initial state is none other than the final state which has been obtained in the previous transfer.

In order to carry out the transfer of the magnetic energy contained in the inductance coil 30 to the inductance-coil unit 32 formed by the plurality of partial inductances $L_p$, the following successive operations are applied:

closure of the switch $I_1$
opening of the switch $J_1$
closure of the switch $I_2$
opening of the switch $J_2$
.....
closure of the switch $I_n$
opening of the switch $J_n$
closure of the switch 34.

The final state obtained is none other than the initial state of the previous transfer.

In order that the device of FIG. 8 should have an appreciable transfer efficiency, the values $L_p$ of the partial inductances of the coil unit 32 must not be indeterminate. If $n$ is the number of said inductances and if L is the value of inductance of the coil 30, the value $L_p$ of a partial inductance having the index $p$ must be as close as possible to the value:

$$L_p = L\left[tg\,\frac{\pi p}{2n} - tg\,\frac{\pi(p-1)}{2n}\right]^2 \qquad (10)$$

This formula is established on the basis of the graphical representation of FIG. 3 in respect of $n$ transformations having an angular amplitude $\pi/2n$. If these conditions are satisfied and if the partial-inductance coils are in mutual induction which is as total as possible, the transfer takes place with an efficiency equal to the value indicated by the equation (9), that is to say in the case of a high value of $n$ : $\eta = 1 - (\pi 2/4n)$. If the law (10) is not strictly satisfied, the efficiency is slightly lower than the theoretical value but the calculations and experience of the present applicants have shown that the law is not very critical.

It is pointed out that the last partial inductance $L_n$ cannot be physically realized since $tg\ (\pi/2) = \infty$ . A limitation is therefore set in practice on the final transfer concerning the inductance having an index $p = n$-1. If reference is made to the diagram of FIG. 3, it is apparent that this has no incidence on the efficiency since the ordinate of the point $M_{n-1}$ is the same as that of $M_n$.

If the storage inductance coil has a fixed value for reasons of construction, the transfer to the load inductance coil is carried out by putting progressively in circuit the inductance coils having the values $L_p$ from $p = 1$ to $n$-1 inclusive. On the other hand, if the load inductance coil has a fixed value, the switching means are actuated so as to progressively short-circuit the inductance coils $L_p$ from $p = n\text{-}1$ to $p = 1$.

If the coils are formed of a uniform number $m_p$ of turns, the equation (10) on $L_p$ results in a simple equation on $m_p$:

$$m_p = K\left[tg\,\frac{\pi p}{2n} - tg\,\frac{\pi(p-1)}{2n}\right] \qquad (11)$$

where K is a constant which depends on the circuit and $p$ from 1 to $n$-1 inclusive and tg refers to tangent.

In an arrangement which is slightly different from that of FIG. 8. the device in accordance with the invention is provided with switching means formed by a plurality of switches arranged in accordance with FIG. 9; there is again shown in this figure the inductance coil 30 formed by a single winding and the inductance-coil unit 32 formed by a plurality of partial-inductance coils associated with switches $M_1, M_2 \ldots M_n$ and $N_1, N_2, \ldots N_n$ symbolically noted by $M_p$ or $N_p$, respectively, where $p$ varies from 1 to $n$ ; in this arrangement, each partial-inductance coil $L_p$ is associated in parallel with a network having three arms each comprising a switch, each network having one arm in common with the preceding network and another arm in common with the following network. Thus, the inductance coil $L_2$ is associated with a network which contains in addition to the switch $N_2$, the switch $M_2$ which is in common with the preceding inductance coil $L_1$ and the switch $M_3$ which is in common with the following inductance coil $L_3$. In accordance with this arrangement, in order to carry out the transfer between the inductance-coil unit 32 and the inductance coil 30, sequences which are similar to those described earlier would be applied to the switches $M_p$ and $N_p$.

The two particular arrangements of FIGS. 8 and 9 result in inductance coils 30 and 32 having very different characteristics since one coil (30) is constituted by a single inductance and the other coil (32) is constituted by a plurality of partial inductances. Since these requirements are not always compatible with practice, this situation can be avoided by making use of a symmetrical circuit arrangement of the type shown in FIG. 10.

In this figure, there is shown the general diagram of an electrical system which makes use of an intermediate inductance. The inductance coils between which it is desired to effect the transfer of energy are the coils 40 and 42 which can be either identical or at least of very similar design; on the other hand, the inductance coil 44 which is employed as intermediate storage inductance is constituted by a plurality of partial-inductance coils such as those described in the foregoing in connection with FIGS. 8 and 9 and with the equation 10. The transfer of the magnetic energy contained in the coil 40 first takes place in the direction of the coil 44 and then, in a second stage, the transfer of energy contained in the coil 44 takes place towards the inductance coil 42. These transfers can be effected by means of the plurality of switches M and N which are similar to those shown in FIG. 9 and by means of the two switches 46 and 48.

Figure 11:
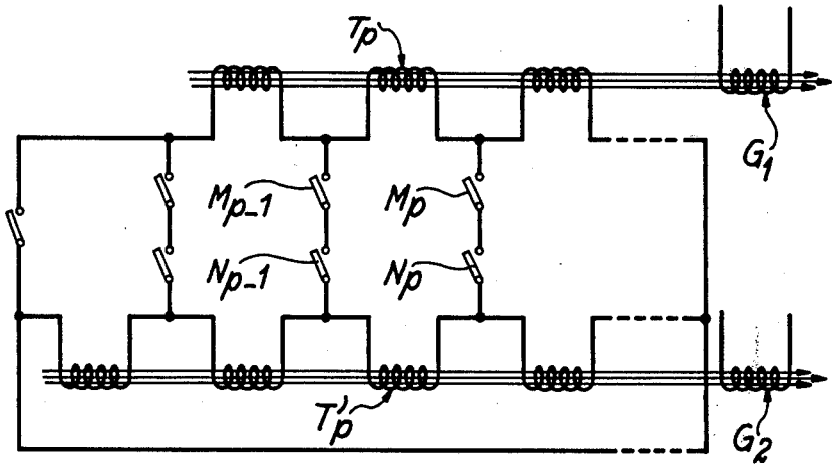
FIG. 11 illustrates an alternative embodiment in which the two inductance coils can be varied simultaneously.

The devices of FIGS. 8, 9 and 10 comprise a single variable inductor; in a slightly different arrangement, the two inductance coils, namely the storage coil and load coil, can be variable simultaneoUsly as is shown in FIG. 11.

In this figure, the inductances are constituted by a series of unitary inductance-coils $Tp$ and $T'p$ in series and in total mutual induction having the respective series and in total mutual induction having the respective values:

$$T_p = T\left[\cos\frac{\pi(p-1)}{2n} - \cos\frac{\pi p}{2n}\right]^2$$

$$T'_p = T\left[\sin\frac{\pi p}{2n} - \sin\frac{\pi(p-1)}{2n}\right]^2$$

The switching device is represented by the plurality of switches $M_{p\text{-}1}$, $M_p$ and $N_{p\text{-}1}$, $N_p$ . The inductance coils may or may not be coupled to auxiliary circuits $G_1$ and $G_2$. In this arrangement, the state having the order$p$-1 is such that the switches $N_K$ are open up to $K = p\text{-}2$ inclusive and closed beyond this value and the switches $M_K$ are closed up to $K = p-1$ inclusive and open beyond this value. In order to obtain the following state having the order $p$, the switch $M_p$ is closed and the switch $N_{p-1}$ is open.

If the inductance coils $T_p$ and $T'_p$ are formed of uniform windings, the number of turns which are necessary in order to constitute these partial inductances is respectively:

$$m_p = K\left[\cos\frac{\pi(p-1)}{2n} - \cos\frac{\pi p}{2n}\right]$$

$$m'_p = K'\left[\sin\frac{\pi p}{2n} - \sin\frac{\pi(p-1)}{2n}\right]$$

In one variant of the device of FIG. 11, the two inductance coils may form only a single unit which is short-circuited progressively. In this case, the winding is carried out uniformly along a cylinder and the turns are in mutual induction which decreases with their respective distances. The magnetic energy which was initially distributed throughout the winding is progressively transferred to one end of the coil.

In all the alternative forms of construction which are shown in FIGS. 8, 9, 10 and 11, the auxiliary circuit G is in total mutual coupling with the inductance coil whose value is caused to vary progressively and may or may not comprise a capacitive element which, if this latter is present, results in oscillations of the current $i_G$ with which the transformations of the main circuit are synchronized as has been explained earlier.

The foregoing description has been concerned with the alternative forms of construction which make use of a circuit with a transformer have a fixed ratio; there will now be described another alternative embodiment which is characterized in that the two inductance coils are fixed and coupled through a transformer having a variable ratio as shown diagrammatically in FIG. 12.

This figure again shows the inductance coils 1 and 2 between which the transfer is effected; a transformer 50 couples said coils and a contact-stud rheostat 52 serves to vary the transformation ratio of the transformer 50; the number of contact-studs is $n$ and any given contact-stud is designated by the index $q$. The auxiliary circuit G is coupled to the main circuit by means of the magnetic core of the transformer. Said circuit may or may not comprise a capacitive element such as the capacitor 18 which is shown in dashed outline.

Figure 12:
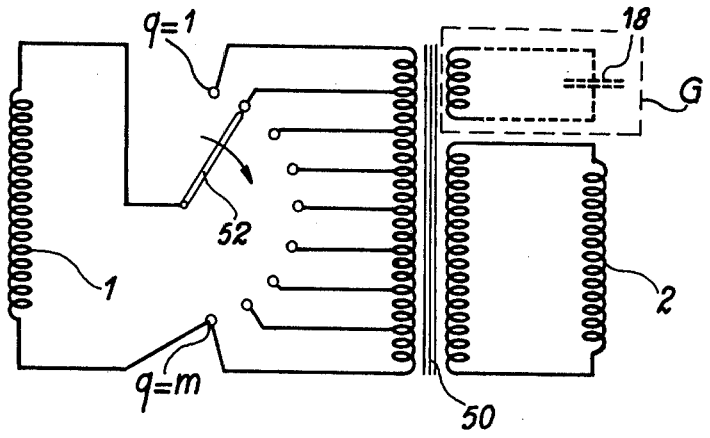
FIG. 12 is a general arrangement diagram showing the transfer between two fixed-inductance coils which are coupled by means of a transformer having a variable ratio.

A current $i_G$ of the zero auxiliary circuit corresponds to any position of balance of the complete circuit; since the ratio of primary and secondary currents is directly related to the transformation ratio $K_q$ of the transformer 50, the ratio of the numbers of turns of the primary and secondary circuits of the transformer must consequently vary in accordance with a well-determined law in order that the transfer efficiency should be close to 1 to an extent already shown by the study of the method which was made earlier. In this alternative embodiment of the invention which makes use of a transformer and in the case of a transfer which takes place from the coil 1 towards the coil 2, it can thus be demonstrated that the transformation ratio $K_q$ of the transformer which couples the coils 1 and 2 having the respective values of inductance $L_1$ and $L_2$ must be such that:

$$K_q = \sqrt{\frac{L_1}{L_2}} \cdot tg \frac{\pi q}{2m} \qquad (12)$$

where $q$ successively assumes all the values from 1 to $m$ (direction of the arrow in FIG. 12). In actual fact, the final value in respect of $q = m$ is not obtained physically since tg $(\pi/2) = \infty$ so that in practice, the law 12 is satisfied only from $q = 1$ to $q = m-1$ inclusive. In the case of transfer from the coil 2 to the coil 1, it would naturally be necessary to cause the index $q$ to vary from $m-1$ to 1.

Figure 13:
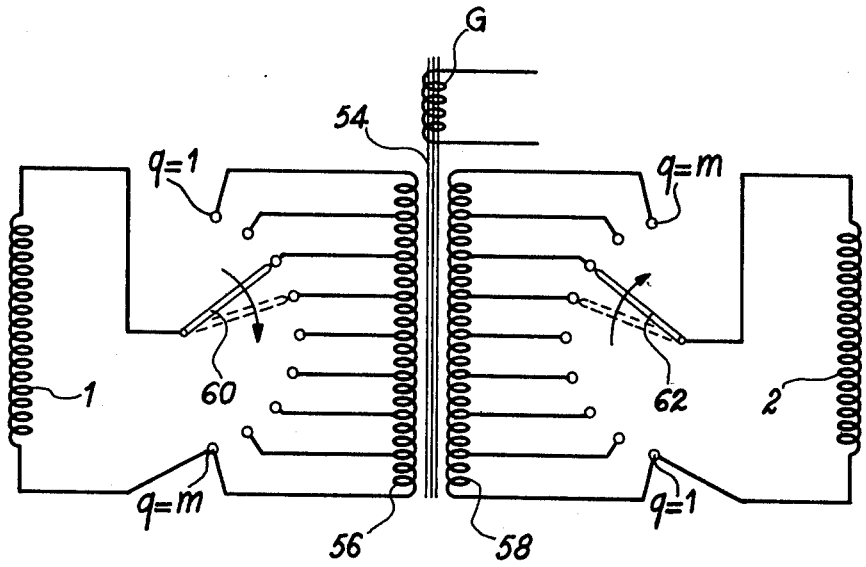
FIG. 13 is an alternative form of FIG. 11 in which the transformer has variable primary and secondary windings.

In accordance with a particular feature of the invention, the transformer can be provided with variable primary and secondary windings as shown in FIG. 13. In this figure, the inductance coils 1 and 2 are coupled by means of the transformer 54; by means of the rheostats 60 and 62 which contain m contact-studs numbered from 1 to m, the primary 56 and the secondary 58 of said transformer can assume all the following discrete values:

$$\left.\begin{array}{l} (m_1)_q = M_1 \cos \frac{\pi q}{2m} \\ (m_2)_q = M_2 \sin \frac{\pi q}{2m} \\ \text{where } q \text{ varies from 1 to } m \text{ with} \\ \frac{M_1}{M_2} = \sqrt{\frac{L_1}{L_2}} \end{array}\right] \qquad (13)$$

It is in fact clear that this arrangement and the equations 13 are only one particular case of the arrangement of FIG. 12 and of equation 12.

In some applications and especially those entailing the need for magnetic field coils, it is sometimes useful to obtain a current variation in the load inductance coil which is not subjected to any abrupt discontinuity or even which is an increasing monotonic function of time. To this end, it is preferable to know the variations in the current which flows in the load inductance coil or the variations in the current $i_G$ which flows in the auxiliary circuit. If one plots the variations in the current $i_G$ during the different stages of transfer, one obtains a curve such as that shown in FIG. 14 wherein $m_G$ represents the number of turns of the auxiliary circuit G which is coupled to the variable element of the main circuit and wherein the circuit G comprises a capacitive element which produces an oscillation of the current $i_G$.

Figure 14:
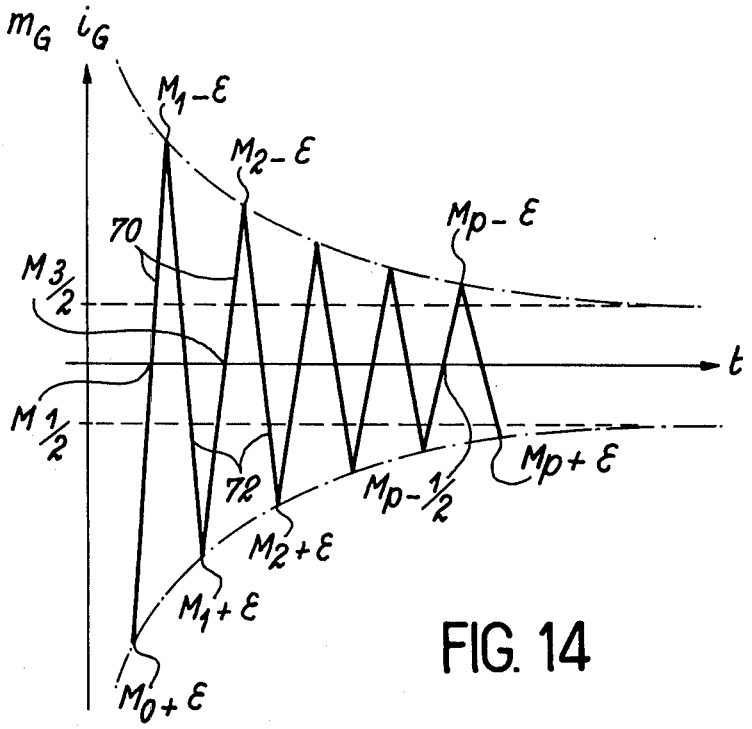
FIG. 14 shows the general current variation in the auxiliary circuit in the case of a transfer between a variable-inductance coil and a fixed-inductance coil.

In this figure, the time is plotted as abscissae and the product $m_G\, i_G$ is plotted as ordinates. It is apparent that the peak current in the active circuit G is irregular if $m_G$ is constant. The maximum amplitudes are determined by the points $M_o$, $M_1$, $M_2$ etc . . . which correspond to the points of the graph of FIG. 6 which are designated by the same references; the notations $M_p + \epsilon$ and $M_p - \epsilon$ represent the state which follows $M_p$ both before and after switching of the elements which serve to modify the main circuit. The zero-current points which have a fractional index correspond to the transitions through a minimum total energy $W_T$. In FIG. 14, the straight line segments designated by the reference 70 represent the energy transfers between the two windings whereas the straight line segments designated by the reference 72 represent the phases of cancellation of the current within the turns which are in short-circuit.

Figure 15:
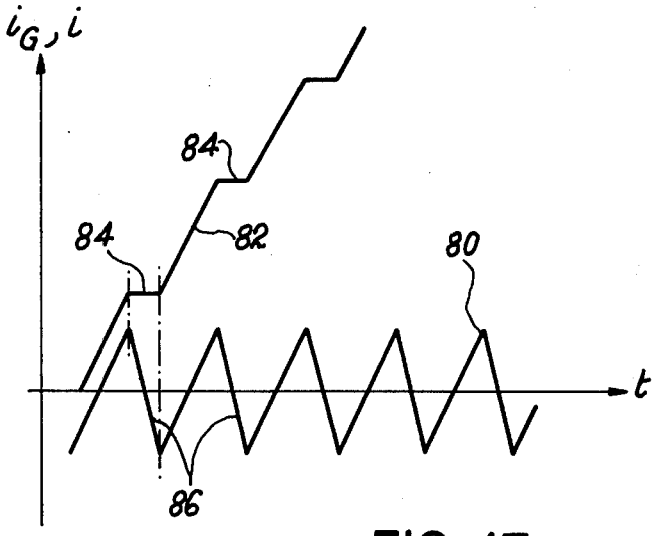
FIG. 15 shows the progressive variation of currents in the case of a transfer between two fixed-inductance coils which are coupled by means of a transformer having a variable ratio.

The variation in amplitude of the current $i_G$ is due to the non-symmetrical function performed by the windings $L_1$ and $L_2$ in the circuit arrangement of the type shown diagrammatically in FIG. 7. In order to make the functions more symmetrical, it is necessary to adopt an arrangement such as that shown in FIG. 13, for example, in which the transformer has variable primary and secondary windings and in which it can be shown that the peak amplitude of the current $i_G$ is constant in accordance with the representation of FIG. 15. Under these conditions, the variations in the current $i_G$ are represented by the triangular signals 80 and the variations in the current i in the main circuit are represented by the curve 82; in symmetrical circuit arrangements of the type shown in FIG. 13, the energy transfer between the inductance coils accordingly takes place with level stages or plateaus such as the plateaus 84 which are associated with the passing of the peaks $M_p$ corresponding to the portions of curve 86 on the curve which is representative of the variations in current $i_G$.

Figure 17:
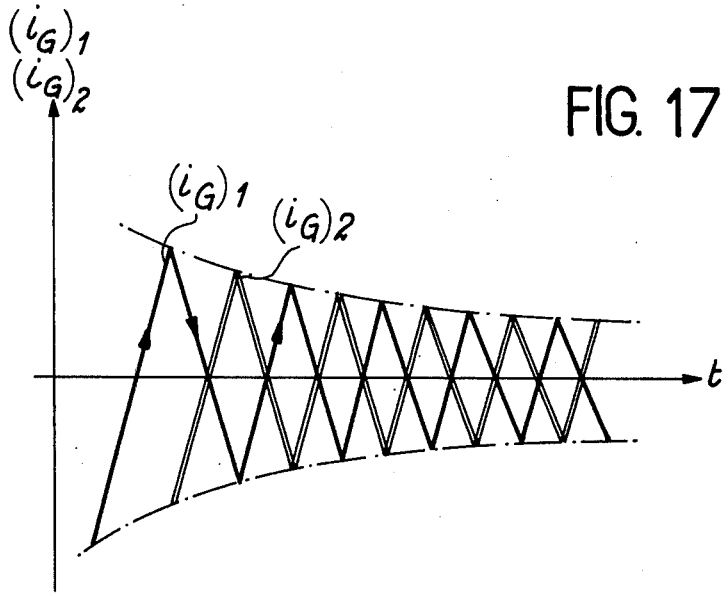
FIG. 17 is a diagram showing the current variations within the two auxiliary circuits in the case of the symmetrical assembly of FIG. 16.
Figure 16:
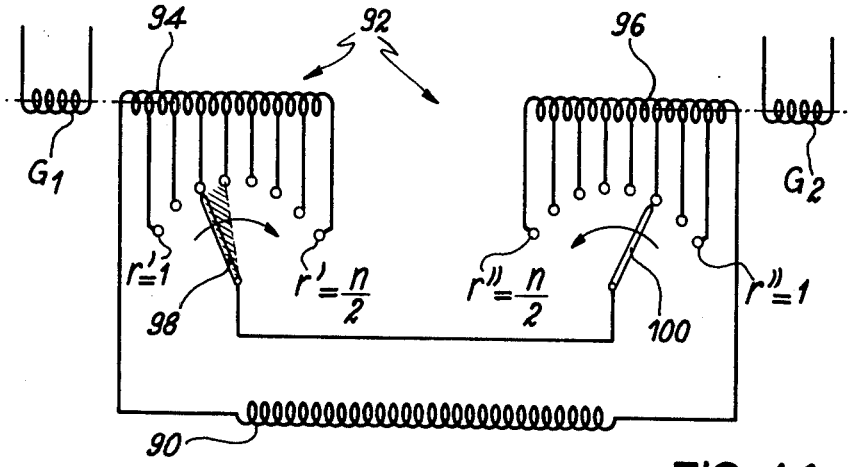
FIG. 16 shows a symmetrical device in which the inductance undergoing transfer is made up of two symmetrical portions.

In order to prevent the existence of plateaus in the curve 82 and generally in order to prevent abrupt current variations which result in substantial overvoltages in the inductance coils, provision is made in accordance with the invention for the use of symmetrical circuit arrangements such as those shown in FIGS. 16 and 17.

In FIG. 16, a coil 90 having a value of inductance L and consisting of a single winding is associated with an inductance coil 92 having two identical halves 94 and 96 each constituted by $n/2$ partial-inductance elements having the indices $r'$ and $r''$ and a value $L'_{r'} = L''_{r''}$, said elements being connected in series and in total coupling by mutual induction, the values of $L'_{r'}$ and $L''_{r''}$ being in the vicinity of:

$$L'_{r'} = L''_{r''} = \frac{L}{2}\left[tg\frac{\pi r}{n} - tg\frac{\pi(r-1)}{n}\right]^2 \qquad (14)$$

where $r'$ and $r''$ are integers which vary between 1 and $n/2$ and $tg$ refers to tangent. These inductance coils are associated with means whereby the inductance elements $L'_{r'}$ and $L''_{r''}$ are short-circuited progressively and in synchronism. It is readily apparent that in practice, the end inductances $L'n/2$ and $L''n/2$ are not of infinite value but only very high and that the law (14) is strictly satisfied only in respect of the $(n/2\text{-}1)$ first partial inductances.

In the case of FIG. 16, the switching means are constituted by two rheostats 98 and 100 in synchronism and each having $n/2$ contact-studs numbered from 1 to $n/2$. In a symmetrical arrangement of this type, it can thus be readily seen that the variations in the current $i_G$ are obtained by forming the sum of two sawtooth curves of the type shown in FIG. 14 which are displaced by one period since the load coils 94 and 96 collect the energy of the storage inductance coil 90 in alternate sequence, the stage of short-circuiting one of the coils being carried out conjointly with the transfer of energy into the other coil. The active circuits $G_1$ and $G_2$ are then supplied with symmetrically distributed currents as shown in FIG. 17 and the current variations in the main circuit no longer have plateaus.

Figure 18:
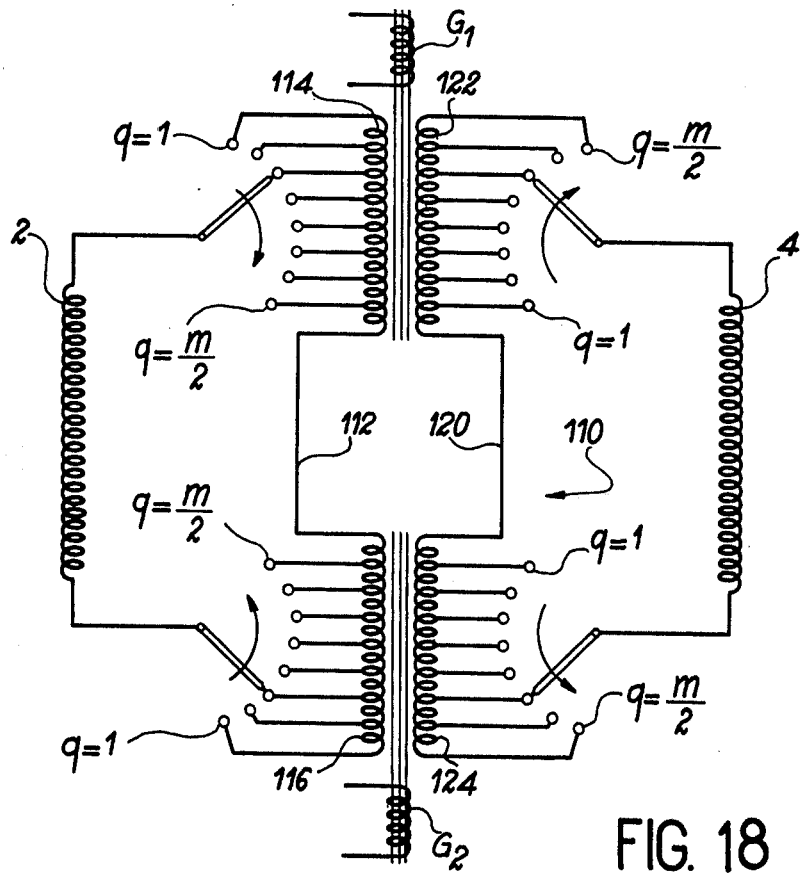
FIG. 18 is a diagram of a device which provides uniform energy transfer and comprises two symmetrical transformers.

In another alternative form of device which is completely symmetrical, the invention provides for a device of the type shown diagrammatically in FIG. 18. This circuit is provided with a transformer 110 comprising a primary winding 112 constituted by two identical and symmetrical portions 114 and 116 which are connected in opposition and can each assume the discrete sequence of $m/2$ values:

$$(\mu_1)_q = (\mu_1')_q = \frac{M_1}{2} \cos \frac{\pi q}{m} \qquad (18)$$

and by a secondary winding 120 consisting of two identical and symmetrical portions 122 and 124 which are connected in opposition and are each capable of assuming the discrete sequence of $m/2$ values:

$$(\mu_2)_q = (\mu_2')_q = \frac{M_2}{2} \sin \frac{\pi q}{m} \qquad (19)$$

where the index $q$ assumes the values within the range of 1 to $m/2$.

The auxiliary circuits $G_1$ and $G_2$ of FIG. 18 are then supplied with symmetrically distributed currents as in FIG. 17.

In the foregoing description with reference to the different arrangements provided by the invention, the auxiliary circuit is represented as being constituted by an inductance coil and a capacitor, thereby giving rise to oscillations of the current $i_G$. In another arrangement, said auxiliary circuit comprises an inductance coil in mutual induction with the element of the circuit which is transformed and a current generator for feeding into the auxiliary circuit a periodic current, the period of which is that of the successive transformations of the circuit. In particular, said generator can be produced by a sawtooth current of the type shown by way of example in FIG. 15.

In the particular arrangements of the invention which have just been described, the switches have been represented by conventional signs; in practice, so far as the contact-making switches (circuit closers) are concerned, the invention proposes to form said switches in some cases by oblique projection of a metallic plate onto the sucessive contact-studs which are connected to the terminals of the different inductance coils; and in the case of the break switches (circuit breakers), it is intended to make use of exploding wires. The movement of the metallic plate can be obtained by gas pressure (such as the pressure of an explosive mixture, for example) or by magnetic pressure by utilizing the Laplace forces related to the electric currents which flow in the system. In some designs of the type shown by way of example in FIG. 11, the cross-sectional area of the fusible wires can be so calculated that the wires explode one after the other in a suitable order solely as the result of passage of the current. This is the case in particular with any one of the switches $N_{p-1}$, $N_p$ of FIG. 11. The circuit closers $M_{p-1}$, $M_p$ can also be designed in the form of wires which are supplied with external current pulses and break an insulating strip as they explode. The circuit closers $M_{p-1}$, $M_p$ can also be designed in the form of wires which are supplied by the main current and have a cross-sectional area such that they explode before the wires $N_{p-1}$, $N_p$ thus providing a self-tripping system.

The same applies to the inductance coils which have been represented by conventional signs and for which any one skilled in the art can readily determine the form which is best suited to practical requirements, viz: coils, solenoids, flat disc-type coils, turns and the like. Nevertheless, in a particular alternative design which is contemplated by the invention, the windings of the different inductance coils aforesaid are formed of superconducting material. The magnetic energy which is stored in the corresponding circuits then becomes of very high value and this justifies the importance which may be attached to high-efficiency recovery of said energy by adopting the method and the device according to the invention.

What we claim is:

1. A device for the high-efficiency transfer of magnetic energy contained in a storage inductance coil into a load inductance coil, wherein the storage inductance coil has a fixed value L and wherein the load inductance coil is constituted by $n$ partial-inductance coils of values $L_1, L_2, \ldots L_n$ which are connected in series and in total coupling by mutual induction, the value $L_p$ of the $p^{th}$ of the $(n-1)$ first inductance coils $L_1, L_2, \ldots L_{n-1}$ being in the vicinity of:

$$L_p = L\left[tg\,\frac{\pi p}{2n} - tg\,\frac{\pi(p-1)}{2n}\right]^2$$

where $p$ is an integer index, $1 \leqslant p \leqslant n-1$, tg is tangent and $L$ a constant and wherein said device comprises switching means whereby the inductance coils $L_1, L_2, \ldots L_{n-1}$ are progressively put in circuit.

2. A device according to claim 1, wherein the $n$ partial-inductance coils are formed by uniformed windings having a number of turns in the vicinity of $$K\left[tg\,\frac{\pi p}{2n} - tg\,\frac{\pi(p-1)}{2n}\right]$$

for the $p^{th}$ coil, where $p$ varies from 1 to $(n-1)$ inclusive and $K$ is a constant.

3. A device according to claim 1, wherein the means for switching the $n$ partial-inductance coils are constituted by $2n$ switches, each Partial-inductance coil being associated with a first switch in series with said coil and with a second switch in parallel with said coil.

4. A device according to claim 1, wherein the means for switching the $n$ partial-inductance coils are constituted by $2n$ switches, each partial-inductance coil being associated in parallel with a network having three arms each containing a switch, each network having one arm in common with the preceding network and another arm in common with the following network.

5. A device according to claim 1, wherein the windings of the different inductance coils are formed of superconducting material.

6. A device for the high-efficiency transfer of magnetic energy contained in a storage inductance coil into a load inductance coil wherein the load inductance coil has a fixed value L' and wherein the storage inductance coil is constituted by $n$ partial-inductance coils of value $L'_1, L'_2, \ldots L'n$ which are connected in series and in total coupling by mutual induction, the value $L'_p$ of the $p^{th}$ of the $(n-1)$ first inductance coils $L_1, L_2, \ldots L_{n-1}$ being in the vicinity of:

$$L'_p = L'\left[tg\frac{\pi p}{2n} - tg\frac{\pi(p-1)}{2n}\right]^2$$

where $p$ is an integer index, $1 \leqslant p \leqslant n-1$ 1 tg is tangent and L' a constant and wherein said device comprises switching means for progressively short-circuiting the inductance coils $L'_{n-1}, L'_{n-2}, \ldots L'_1$.

7. A device according to claim 6, wherein the n partial-inductance coils are formed by uniform windings having a number of turns in the vicinity of $$K\left[tg\frac{\pi p}{2n} - tg\frac{\pi(p-1)}{2n}\right],$$

for the $p^{th}$ coil, where $p$ varies from 1 to $(n-1)$ inclusive and K is a constant and tg is tangent.

8. A device according to claim 6, wherein the means for switching the $n$ partial-inductance coils are constituted by $2n$ switches, each partial-inductance coil being associated with a first switch in series with said coil and with a second switch in parallel with said coil.

9. A device according to claim 6, wherein the means for switching the n partial-inductance coils are constituted by $2n$ switches, each partial-inductance coil being associated in parallel with a network having three arms each containing a switch, each network having on arm in common with the preceding network and another arm in common with the following network.

10. A device for the high-efficiency transfer of magnetic energy contained in a storage inductance coil into a load inductance coil, wherein the load inductance coil has a fixed value L and wherein the storage inductance coil has two identical halves each constituted by n/2 partial-inductance coils $L'_1, L'_2, \ldots L'_{n/2-1}$, for the first half and $L''_1, L''_2, \ldots L''_{n/2-1}$ for the second half, which are connected in series and in total coupling by mutual induction, the value of the $r'^{th}$ value of the first half and the value of the $r''^{th}$ of the second half being in the vicinity of:

$$L'_{r'} = L''_{r''} = \frac{L}{2}\left[tg\frac{\pi r}{n} - tg\frac{\pi(r-1)}{n}\right]^2$$

where $r'$ and $r''$ are integer indices, tg is tangent, and $L$ a constant which vary in synchronism between 1 and wherein said device comprises switching means whereby the $r'^{th}$ inductance coils and the $r''^{th}$ inductance are short-circuited progressively and in synchronism.

11. A device for the high-efficiency transfer of magnetic energy contained in a storage inductance coil into a load inductance coil, wherein the storage inductance coil is constituted by $n$ partial-inductance coils $T_1, T_2, \ldots T_n$ which are connected in series and in total coupling by mutual induction, the value $T_p$ of the $p^{th}$ inductance coil being in the vicinity of:

$$T_p = T\left[\cos\frac{\pi(p-1)}{2n} - \cos\frac{\pi p}{2n}\right]^2$$

where $p$ is an integer, 1 $p$ $n$, and $T$ a constant and wherein the load inductance coil is constituted by $n$ partial-inductance coils $T'_1, T'_2, \ldots T'_n$ which are connected in series and in total coupling by mutual induction, the value $T'_p$ of the $p^{th}$ inductance coil being in the vicinity of:

$$T'_p = T\left[\sin\frac{\pi p}{2n} - \sin\frac{\pi(p-1)}{2n}\right]^2$$

and wherein said device comprises switching means whereby the storage and load inductance coils are caused to vary progressively and simultaneously.

12. A device for the high-efficiency transfer of magnetic energy contained in a storage inductance coil into a load inductance coil, wherein said device comprises a storage inductance coil having a fixed value $L_1$ and a load inductance coil having a fixed value $L_2$, a transformer, switch means for coupling said coils through said transformer, said transformer having a transformation ratio which is capable according to the state of plurality of said switch means of assuming any one of $m-1$ values:

$$K_q = \sqrt{\frac{L_1}{L_2}}\ tg\frac{\pi q}{2m}$$

where $q$ is an integer between 1 and $m-1$ and $tg$ is tangent, and said switch means being actuable to a plurality of states for establishing the sequence of values of $K_q$.

13. A device according to claim 12 wherein said transformer has a primary winding which is capable of assuming $m$ discrete values $(m_1)_1, (m_1)_2 \ldots (m_1)_m$, the qth value being $(m_1)_q$ and equal to $M_1 \cos(\pi q/2m)$ where $M_1$ is a constant and a secondary winding which is capable of assuming $m$ discrete values $(m_2)_1, (m_2)_2 \ldots (m_2)_m$, the qth value being $(m_2)_q$ and equal to $M_2 \sin(\pi q/2m$ where $M_2$ is a constant and wherein $M_1/M_2 = \sqrt{L_1/L_2}$ and q being an integer, $1 \leqslant q \leqslant m$ and said switch means being connected for establishing in synchronism the values $(m_1)_q$ and $(m_2)_q$ for any value of $q$.

14. A device according to claim 13, wherein said transformer has a primary winding constituted by two identical and symmetrical portions connected in opposition and each capable of assuming the discrete sequence of $m/2$ values: $(\mu_1)_1, (\mu_1)_2 \ldots (\mu_1)_{m/2}$ for the first portion and $(\mu'_1)_1, (\mu'_1)_2 \ldots (\mu'_1)_{m/2}$ for the second, the $q^{th}$ value of these sequence being:

$$(\mu_1)_q = (\mu'_1)_q = \frac{M_1}{2} \cos \frac{\pi q}{m}$$

and a secondary winding constituted by two identical and symmetrical portions connected in opposition and each capable of assuming the sequences of discrete values $(\mu_2)_1, (\mu_2)_2 \ldots (\mu_2)_{m/2}$ for the first portion and $(\mu'_2)_1, (\mu'_2)_2 \ldots (\mu'_2)_{m/2}$ for the second, the $q^{th}$ value of these sequences being:

$$(\mu_2)_q = (\mu'_2)_q = \frac{M_2}{2} \sin \frac{\pi q}{m}$$

where $q$ is an integer, $1 \leq q \leq (m/2)$.

15. A device for the high-efficiency transfer of magnetic energy contained in a storage inductance coil into a load impedance, the storage inductance coil and the load impedance being such as to form part of the same circuit, wherein one of the storage inductance coil and the load impedance has a fixed value and wherein the number of turns of the other of the storage inductance coil and the load impedance is progressively modified by a plurality of switches, wherein the inductance coil which is transformed is inductively coupled to a passive auxiliary resonant circuit and wherein the transformations of the circuit are synchronized with the oscillations of the current in said auxiliary circuit wherein said auxiliary circuit comprises and inductance coil in total mutual induction with the inductance coil having a number of turns which is progressively modified, and a capacitor.

16. A device for the high-efficiency transfer of magnetic energy contained in a storage inductance coil into a load inductance coil, wherein the storage inductance coil is coupled to the load impedance coil by means of a transformer and wherein the transformation ratio of said trnasformer is caused to vary progressively, wherein said transformer is inductively coupled to a passive auxiliary resonant circuit and wherein the transformations of the circuit are synchronized with the oscillations of the current in said auxiliary circuit wherein said auxiliary circuit comprises an inductance coil coupled to said transformer and a capacitor.

17. A device for the high-efficiency transfer of magnetic energy contained in a storage inductance coil into a load impedance, the storage inductance coil and the load impedance being such as to form part of the same circuit, wherein one of the storage inductance coil and the load impedance has a fixed value and wherein the number of turns of the other of the storage inductance coil and the load impedance is progressively modified by a plurality of switches, wherein the inductance coil which is transformed is inductively coupled to an active circuit into which is injected a current having periodic variations and wherein the transformations of said inductances are synchronized with the periodic variations of the injected current, wherein the auxiliary circuit comprises an inductance coil in mutual induction with the inductance coil which is transformed and a current generator for injecting a periodic current in said auxiliary circuit, the period of said current being that of the successive transformations of the circuit.

18. A device according to claim 17, wherein said generator is a sawtooth current generator.

19. A device for the high-efficiency transfer of magnetic energy contained in a storage inductance coil into a load inductance coil wherein the storage inductance coil is coupled to the load impedance coil by means of a transformer and wherein the transformation ratio of said transformer is caused to vary progressively, wherein said transformer is inductively coupled to an active auxiliary circuit into which is injected a current having periodic variations and wherein the transformations of said transformer are synchronized with the periodic variations of the injected current, wherein the auxiliary circuit comprises an inductance coil in mutual induction with said transformer and a current generator for injecting said periodic current, the period of said current being that of the successive transformations of the circuit.

20. A device according to claim 19, wherein said generator is a sawtooth current generator.

* * * * *